US008594915B2

(12) United States Patent
Sakhpara

(10) Patent No.: US 8,594,915 B2
(45) Date of Patent: Nov. 26, 2013

(54) TRAFFIC ALERT SYSTEM AND METHOD

(75) Inventor: Ketul Sakhpara, Plano, TX (US)

(73) Assignee: Samsung Electronics Co., Ltd., Suwon-Si (KR)

( * ) Notice: Subject to any disclaimer, the term of this patent is extended or adjusted under 35 U.S.C. 154(b) by 1284 days.

(21) Appl. No.: 11/330,850

(22) Filed: Jan. 12, 2006

(65) Prior Publication Data

US 2007/0038360 A1 Feb. 15, 2007

Related U.S. Application Data

(60) Provisional application No. 60/707,878, filed on Aug. 12, 2005.

(51) Int. Cl.
*G06G 7/76* (2006.01)

(52) U.S. Cl.
USPC ..... 701/118; 701/117; 701/119; 340/933; 340/934; 340/995.13

(58) Field of Classification Search
USPC ..... 701/117, 118, 119, 213; 340/933, 934, 340/995.13
See application file for complete search history.

(56) References Cited

U.S. PATENT DOCUMENTS

| | | | | |
|---|---|---|---|---|
| 6,246,376 | B1 | 6/2001 | Bork et al. | |
| 6,256,577 | B1 * | 7/2001 | Graunke | 701/117 |
| 6,360,102 | B1 | 3/2002 | Havinis et al. | |
| 6,427,113 | B1 * | 7/2002 | Rahman | 701/117 |
| 6,480,783 | B1 * | 11/2002 | Myr | 701/117 |
| 6,628,233 | B2 * | 9/2003 | Knockeart et al. | 342/357.1 |
| 6,708,107 | B2 * | 3/2004 | Impson et al. | 701/117 |
| 6,973,384 | B2 * | 12/2005 | Zhao et al. | 701/117 |
| 6,999,779 | B1 | 2/2006 | Hashimoto | |
| 7,027,915 | B2 * | 4/2006 | Craine | 701/117 |
| 7,096,115 | B1 * | 8/2006 | Groth et al. | 701/117 |
| 7,176,813 | B2 * | 2/2007 | Kawamata et al. | 340/995.13 |
| 7,177,651 | B1 | 2/2007 | Almassy | |
| 7,228,224 | B1 * | 6/2007 | Rosen et al. | 701/117 |
| 7,246,007 | B2 * | 7/2007 | Ferman | 701/200 |
| 7,359,713 | B1 * | 4/2008 | Tiwari | 455/456.1 |
| 7,480,560 | B2 * | 1/2009 | Boll | 701/117 |
| 2004/0174843 | A1 * | 9/2004 | Kubler et al. | 370/328 |
| 2004/0239531 | A1 * | 12/2004 | Adamczyk | 340/995.13 |

* cited by examiner

*Primary Examiner* — Thomas Black
*Assistant Examiner* — Peter D Nolan

(57) ABSTRACT

A system is provided that includes a network server and a plurality of mobile devices that communicate with the network server. Each mobile device is associated with a vehicle and is configured to provide Global Positioning System (GPS) parameters to the network server. The network server uses the GPS parameters to detect traffic congestion in a zone.

20 Claims, 4 Drawing Sheets

TRAFFIC ALERT SYSTEM AND METHOD

CROSS-REFERENCE TO RELATED APPLICATIONS

This application claims priority to the provisional application, U.S. Pat. App. No. 60/707,878, entitled "Cellular Traffic Alerts", filed on Aug. 12, 2005, by Ketul Sakhpara, which is incorporated herein by reference for all purposes.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present disclosure is directed to providing traffic alerts, and more particularly, but not by way of limitation, to providing traffic alerts based on cellular, digital and/or other phones or mobile devices that implement positioning technology such as Global Positioning System (GPS).

BACKGROUND OF THE INVENTION

Vehicular traffic congestion on roadways can be caused due to construction, stalled vehicles, accidents, events, or other causes. Gathering and distributing traffic data can be time-consuming and expensive. For example, some existing methods of gathering traffic data are based on helicopters, cameras, sensors, or drivers that communicate traffic conditions on particular roadways. As the number of roadways being monitored increase (e.g., in a large metropolitan area), the time and expense involved to gather and distribute traffic data also increase. Some existing methods to distribute traffic data are based on radio broadcasts or "mesh networks" (i.e., networks that distribute traffic data from one driver's mobile device to another using close-range wireless technology such as Bluetooth or "wifi"). At least one of the purposes of gathering and distributing traffic data is to enable drivers to avoid areas of traffic congestion. Improved methods of gathering and distributing traffic data are desirable.

SUMMARY OF THE INVENTION

In at least some embodiments, a system is provided that comprises a network server and a plurality of mobile devices that communicate with the network server. Each mobile device is associated with a vehicle and is configured to provide Global Positioning System (GPS) parameters to the network server. The network server uses the GPS parameters to detect traffic congestion in a zone.

In at least some embodiments, a mobile device is provided that includes a processor, a wireless transceiver coupled to the processor, and a Global Position System (GPS) unit coupled to the processor. The GPS unit determines GPS parameters. The mobile device further comprises a memory coupled to the processor. The memory stores instructions that cause the processor to request the GPS parameters from the GPS unit. The GPS parameters are used to detect traffic congestion in a zone.

In at least some embodiments, a method is provided that includes determining a level of traffic congestion in a zone based on Global Positioning System (GPS) parameters associated with a plurality of vehicles. If the traffic congestion is greater than a threshold level, the method generates a traffic alert.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

NOTATION AND NOMENCLATURE

Certain terms are used throughout the following description and claims to refer to particular system components. As one skilled in the art will appreciate, computer companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect, direct, optical, wireless, mechanical, electrical, or other connection. For example, if a first device couples to a second device, that connection may be through a direct electrical connection, through an indirect electrical connection via other devices and connections, through an optical electrical connection, or through a wireless electrical connection.

DETAILED DESCRIPTION OF THE PREFERRED EMBODIMENTS

It should be understood at the outset that although an exemplary implementation of one embodiment of the present disclosure is illustrated below, the present system may be implemented using any number of techniques, whether currently known or in existence. The present disclosure should in no way be limited to the exemplary implementations, drawings, and techniques illustrated below, including the exemplary design and implementation illustrated and described herein, but may be modified within the scope of the appended claims along with their full scope of equivalents.

Embodiments of the disclosure gather and distribute traffic data. In some embodiments, traffic data is gathered using mobile devices (e.g., cellular phones) equipped with global positioning system (GPS) technology. Although GPS technology is described herein, it will be appreciated that any positioning, monitoring, and/or location systems, technologies, or techniques may be used, all of which are referred to herein as GPS systems, and all of which are within the spirit and scope of the present disclosure. In such embodiments, a network server receives GPS parameters (e.g., location and speed) from a plurality of the mobile devices and determines the extent of traffic congestion within one or more "zones". The network server distributes traffic data to users based on a registration and/or subscription process. For example, if traffic congestion within a zone exceeds a threshold level, the network server may cause a traffic alert to be transmitted to the computer or mobile device of a user who has subscribed to receive traffic alerts. Upon receiving a traffic alert, a user may be able to avoid the traffic congestion.

Figure 1:
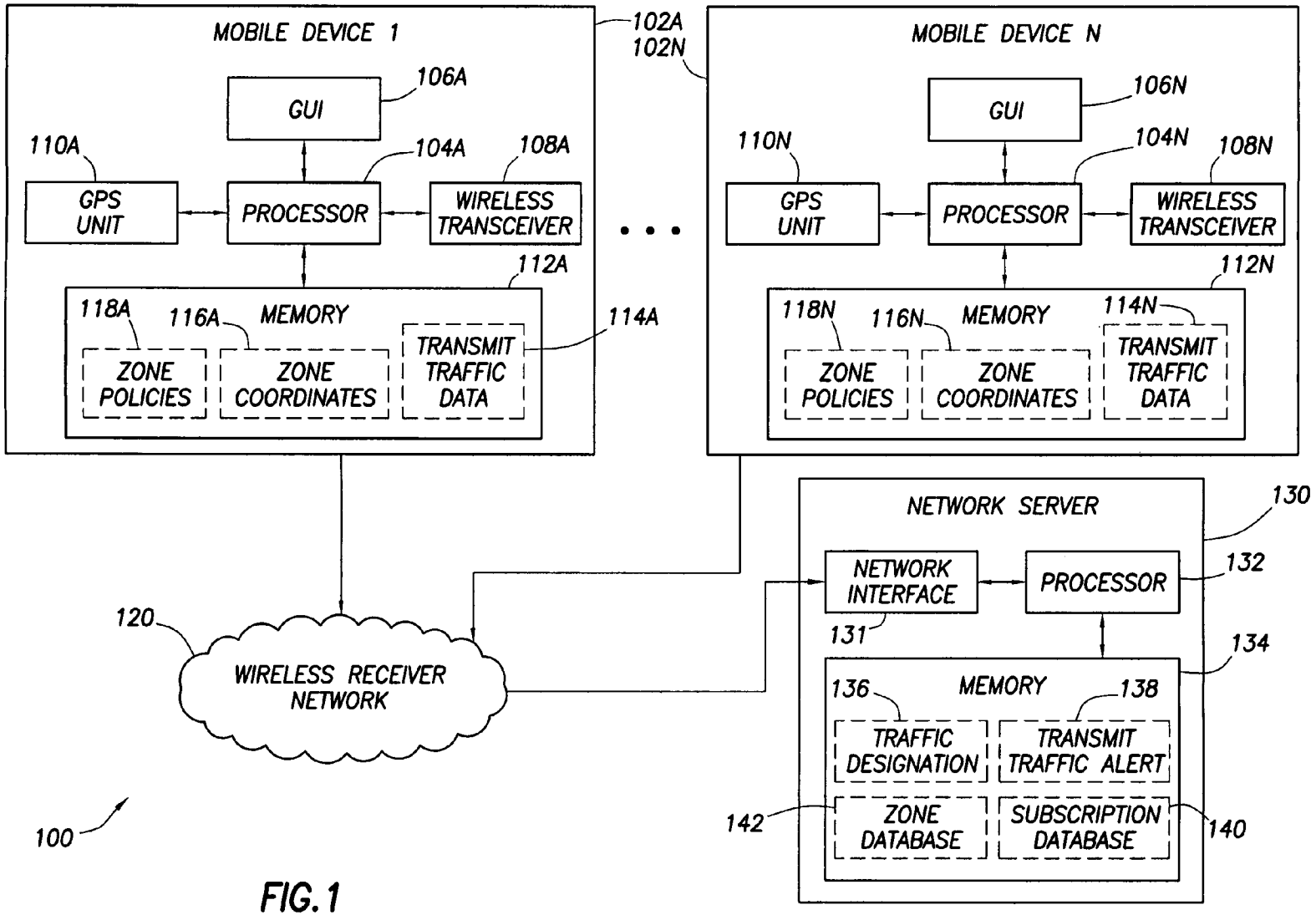
FIG. 1 illustrates a system that gathers traffic data in accordance with embodiments of the disclosure.

FIG. 1 illustrates a system 100 that gathers traffic data in accordance with embodiments of the disclosure. As shown in FIG. 1, the system 100 comprises a plurality of mobile devices 102A-102N that communicate with a network server 130 via a wireless receiver network 120. In at least some embodiments, the mobile devices 102A-102N comprise cellular phones. Additionally or alternatively, the mobile devices 102A-102N could be vehicle based computers or navigation units, or personal digital assistants (PDAs), portable, laptop, or tablet computers, personal, desktop, or other computers, or any mobile telephone or wireless handset or other device that is present or carried in a vehicle. While some of the mobile devices 102A-102N are portable and can be carried by a user (e.g., a cellular phone), other mobile devices may be attached to a vehicle (e.g., a navigation unit provided with the vehicle). Only the mobile device 102A is discussed in greater detail hereafter. However, the same or similar discussion applies to the other systems or mobile devices 102B-102N as well.

As shown, the mobile device 102A comprises a processor 104A coupled to a graphic user interface (GUI) 106A capable of displaying text, graphics, or visual information. In one embodiment, the mobile device 102A may not include a GUI 106A in the case where the mobile device 102A is only used to generate data and may not receive any traffic alert information. In some embodiments, the information may be presented via an audio speaker(s) or vibration units (not shown) on the mobile device 102A. The mobile device 102A also comprises a wireless transceiver 108A, a GPS unit 110A, and a memory 112A. The memory 112A stores "transmit traffic data" instructions 114A. In at least some embodiments, the memory 112A also stores zone coordinates 116A and zone policies 118A as will later be described.

The GPS unit 110A periodically receives satellite signals and calculates parameters such as the time (e.g., 12:30 pm Central Standard Time), the 3-dimensional (x, y, z) coordinate location, and/or the velocity associated with the GPS unit 110A. GPS technology and the process of calculating the above parameters are well known in the art.

When executed, the transmit traffic data instructions 114A causes the processor 104A to request GPS parameters from the GPS unit 110A. Based on the transmit traffic data instructions 114A, the processor 104A either causes GPS parameters to be directly transmitted to the network server 130 (i.e., without further analyzing the data) or analyzes the GPS parameters to determine whether traffic congestion exists as a prerequisite to transmitting the GPS parameters to the network server 130. The GPS parameters can be transmitted to the network server 130 based on a communication protocol such as the Session Initiation Protocol (SIP), the Short Message Service (SMS) protocol, or some other protocol now existing or later developed.

To determine whether traffic congestion exists, the processor 104A compares the GPS coordinates with the zone coordinates 116A stored in the memory 112A. For example, the mobile device 102A may download city road maps based on the location of the mobile device 102A or based on input from a user. These city road maps have corresponding zone (roadway) coordinates 116A. In some embodiments, the zone coordinates can be displayed on the GUI 106A as a map. Once the GPS coordinates are matched with a particular zone, the processor 104A compares the GPS velocity with a speed limit provided by the zone policies 118A stored in the memory 112A. For example, if the zone policies 118A identify the speed limit in a particular zone as 65 mph, the transmit traffic data instructions 114A may allow traffic data (e.g., the GPS coordinates and GPS velocity) to be transmitted to the network server 130 unless the GPS velocity is at least a predetermined level below the 65 mph speed limit (e.g., 20 mph below the speed limit or 30% below the speed limit).

Instead of indicating speed limits, the zone policies 118A may directly indicate threshold speeds at which an unacceptable level of traffic congestion would exist in a zone. Thus, if the GPS velocity is less than the threshold speed indicated for a particular zone, the transmit traffic data instructions 114A causes traffic data (e.g., the GPS coordinates and GPS velocity) to be transmitted to the network server 130. If only the GPS coordinates and GPS velocity are needed by the network server 130 other GPS parameters (e.g., GPS time) are either not transmitted or are ignored by the network server 130.

In some embodiments, the rate at which the mobile device 102A attempts to detect traffic congestion (by comparing the GPS coordinates with the zone coordinates 116A and the GPS velocity with the zone policies 118A) varies according to the location and/or the power level of the mobile device 102A. For example, if the mobile device 102A is powered off (e.g., in a sleep mode) or has less than a threshold amount of power remaining, the mobile device 102A may attempt to detect traffic congestion less often than when the mobile device 102A is powered on or has greater than the threshold amount of power remaining. Additionally or alternatively, if the mobile device 102A is determined to be outside a zone of interest, the mobile device 102A may attempt to detect traffic congestion less often than when the mobile device 102A is determined to be inside a zone of interest. To determine if the mobile device 102A is inside or outside a zone of interest, the GPS coordinates are compared with the zone coordinates 116A stored in the memory 112A.

In embodiments in which the GPS parameters are directly transmitted to the network server 130 (without further analysis by the processor 104A), the network server 130 can be configured to determine whether traffic congestion exists as described above. Also, the rate at which the mobile device 102A directly transmits GPS parameters to the network server 130 can vary according to the location and/or the power level of the mobile device 102A as previously described. The amount of processing performed by the mobile device 102A and the network server 130 can be distributed in many different ways and embodiments of the invention may vary accordingly based on considerations such as the architecture and processing abilities of the mobile devices 102A-102N, the network server 130 and communication networks (e.g., the wireless receiver network 120) that transfer data from the mobile devices 102A-102N to the network server 130. Thus in some embodiments the velocity calculations may be performed by the mobile device 102A, while in other embodiments, only location information is obtained from the mobile device 102A and the network server 130 or other components may calculate the speed at which the mobile device 102A, or vehicle carrying the mobile device 102A, is traveling.

As shown, the network server 130 comprises at least one processor 132 coupled to a network interface 131 and a memory 134. In some embodiments, the memory stores "traffic designation" instructions 136, "transmit traffic alert" instructions 138, a subscription database 140 and a zone database 142. In operation, the network interface 131 receives GPS parameters as previously described via-a wired or wireless connection to the wireless receiver network 120. In some embodiments (e.g., when GPS parameters are directly transmitted from the mobile devices 102A-102N), the network server 130 is configured to process the GPS parameters to detect traffic congestion in a zone. For example, the processor 132 may detect traffic congestion by comparing the GPS coordinates with zone coordinates and the GPS velocity with zone policies as previously described. In alternative embodiments, the network server 130 receives GPS parameters that are known to indicate traffic congestion in a zone. In either case, the network server 130 organizes the received GPS parameters from multiple mobile devices 102A-102N in order to designate one or more zones as being congested and to distribute traffic data to interested users as will later be described.

Figure 2:
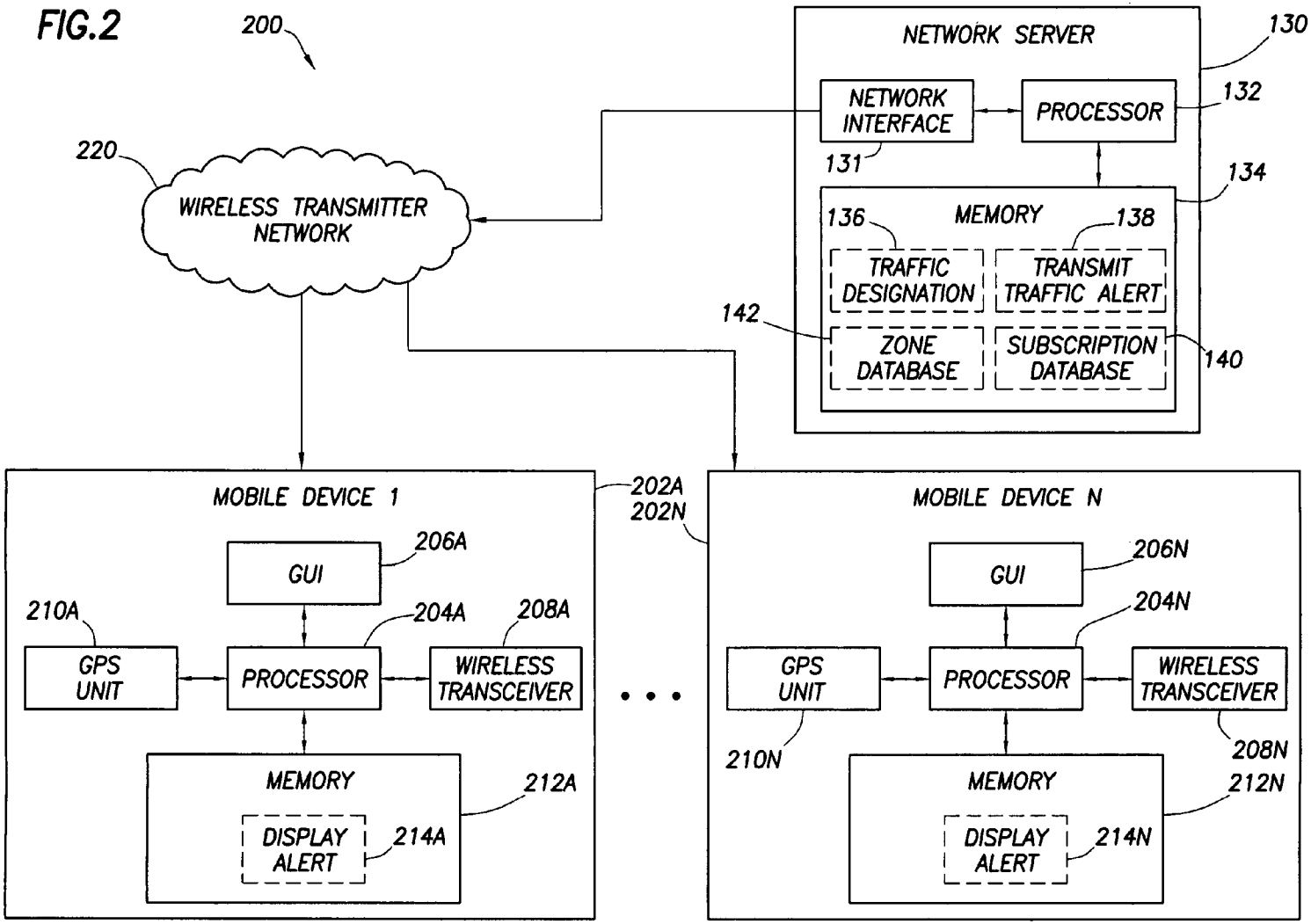
FIG. 2 illustrates a system that distributes traffic data in accordance with embodiments of the disclosure.

FIG. 2 illustrates a system 200 for distributing traffic data in accordance with embodiments of the disclosure. As shown, the system 200 comprises the network server 130 described in FIG. 1. The network server 130 is configured to distribute traffic data to a plurality of mobile devices 202A-202N via a wireless transmitter network 220. In order to distribute the traffic data, processor 132 of the network server 130 accesses the traffic designation instructions 136, the transmit traffic alert instructions 138, the subscription database 140 and the zone database 142 stored in the memory 134.

When executed (e.g., by the processor 132), the traffic designation instructions 136 perform several functions. In some embodiments, the traffic designation instructions 136 require input from a threshold number of mobile devices before designating a zone as being congested. Thus, the traffic designation instructions 136 may cause the processor 132 to assign received GPS parameters to a zone and to count the number of mobile devices in each zone that have GPS parameters indicating traffic congestion. If more than the threshold number (e.g., five) of mobile devices in a zone indicate traffic congestion, the traffic designation instructions 136 can designate the zone as being congested. Tracking the number of mobile devices in each zone that indicate traffic congestion can be accomplished using the zone database 142. Table 1 illustrates information that could be stored in the zone database 142 in accordance with some embodiments of the disclosure.

TABLE 1

| Zone | # of devices that indicate traffic congestion | Designation | Average velocity in zone (mph) |
|---|---|---|---|
| 1 | 0 | Not congested | 65 |
| 2 | 1 | Not congested | 40 |
| 3 | 10 | Congested | 5 |
| 4 | 0 | Not congested | 25 |
| 5 | 4 | Congested | 30 |

As shown in Table 1, information related to zones "1", "2", "3", "4" and "5" is stored and can be dynamically updated. In zone 1, zero mobile devices indicate traffic congestion and the average velocity of vehicles in the zone is determined to be 65 mph. Zone 1 is designated as "not congested". In zone 2, one mobile device indicates traffic congestion and the average velocity of vehicles in the zone is determined to be 40 mph. Zone 2 designated as "not congested". In Zone 3, ten mobile devices indicate traffic congestion and the average velocity of vehicles in the zone is determined to be 5 mph. Zone 3 is designated as "congested". In Zone 4, zero mobile devices indicate traffic congestion and the average velocity of vehicles in the zone is determined to be 25 mph. Zone 4 is designated as "non-congested". In Zone 5, four mobile devices indicate traffic congestion and the average velocity of vehicles in the zone is determined to be 30 mph. Zone 5 is designated as "congested".

Table 1 shows that traffic data and congestion/non-congestion designations can be tracked for different zones regardless of the average speed (or the speed limit) associated with the zone. Table 1 also shows that different zones can be designated as congested even though the average speed and the number of devices that indicate traffic congested in the zones differ (i.e., each zone can have separate rules regarding when to apply the "congested" designation). Table 1 does not necessarily show all the information in the database 142, but illustrates relevant information in accordance with some embodiments of the disclosure. Additionally or alternatively, other information could be stored in the zone database 142 such as the amount of time a zone has been designated as congested, the amount of time since the network server 130 received an update from the mobile devices 102A-102N in a zone, the speed limit in a zone, the threshold speed that indicates congestion in a zone, or other information. By periodically updating information such as the number of devices that indicate traffic congestion and the average speed in a zone, the network server 130 can detect when traffic congestion occurs and when traffic congestion clears.

When executed, the transmit traffic alert instructions 138 accesses the zones in the zone database 142 for comparison with user subscriptions in the subscription database 140. If a user has subscribed to receive traffic alerts for any zone that is designated as congested in the zone database 142, the transmit traffic alert instructions 138 transmits an alert to the user. Table 2 illustrates information that could be stored in the subscription database 140 in accordance with some embodiments of the disclosure.

TABLE 2

| Subscriber | Zones of interest | Where to send traffic alerts |
|---|---|---|
| 1 | 2 | IP address "S1" |
| 2 | 1, 2 | IP address "S2" |
| 3 | 3 | IP address "S3" |
| 4 | 5 | IP address "S4" |
| 5 | 1, 2, 3, 4, 5 | IP address "S5" |

As shown in Table 2, information related to subscribers "1", "2", "3", "4" and "5" is stored and can be dynamically updated. Subscriber 1 has subscribed to receive traffic updates for Zone 2 at internet protocol (IP) address "S1". Subscriber 2 has subscribed to receive traffic updates for Zones 1 and 2 at IP address "S2". Subscriber 3 has subscribed to receive traffic updates for Zone 3 at IP address "S3". Subscriber 4 has subscribed to receive traffic updates for Zone 5 at IP address "S4". Subscriber 5 has subscribed to receive traffic updates for Zones 1, 2, 3, 4 and 5 at IP address "S5".

As an example, if the information in Table 1 is being used, the network server 130 would transmit an alert indicating Zone 3 is congested to subscribers 3 and 5 (at IP addresses S3 and S5, respectively). The network server 130 would also transmit an alert indicating Zone 5 is congested to subscribers 4 and 5 (at IP addresses S4 and S5, respectively). Table 2 does not necessarily show all the information in the subscriber database 140, but illustrates relevant information in accordance with some embodiments of the disclosure. Additionally or alternatively, other information could be stored in the subscriber database 142 such as specific times or intervals at which each subscriber has requested to receive updates. For example, a subscriber may only wish to receive traffic alerts from 6-8 am and from 4-6 pm. The traffic alerts could be sent in 15 minutes intervals or some other interval determined by the user.

As previously described, the network server 130 is configured to transmit traffic alerts to one of more of the mobile devices 202A-202N. Mobile devices 202A-202N may be the same types of devices or systems as the mobile devices 102A-102N described in FIG. 1. Only the mobile device 202A is discussed in greater detail hereafter. However, the same or similar discussion applies to the other mobile devices 202B-202N as well.

As shown, the mobile device 202A comprises a processor 204A coupled to a graphic user interface (GUI) 206A capable of displaying text, graphics, or visual information. The mobile device 202A also comprises a wireless transceiver 208A, a GPS unit 210A, and a memory 212A that stores display alert instructions 114A. In at least some embodiments, the mobile devices that provide the GPS parameters used to determine traffic congestion (e.g., the mobile devices 102A-102N) can also be the mobile devices 202A-202N that receive traffic alerts from the network server 130. Alternatively, the devices 102A-102N of FIG. 1 could be separate from the devices 202A-202N of FIG. 2.

When executed, the display alert instructions 214A cause the processor 204A to provide a traffic alert based on information received from the network server 130. For example, the network server 130 can implement a communication protocol such as SIP, SMS or another protocol to transmit information to the mobile devices 202A-202N. In some embodiments, the traffic alert is used with a map that shows the location of the traffic congestion on the GUI 206A. Additionally or alternatively, the traffic alert comprises a text message (e.g., email, instant messaging, or a "pop-up" message) or audio message that identifies the location of the traffic congestion. In some embodiments, the traffic alert is accompanied by a ring or vibration of the mobile device 202A.

The traffic alert can also suggest an alternative route to the user. In such case, the mobile device 202A can be programmed with a start point (point "A") and end point (point "B") that enables the alternative routes to be determined (between point A and point B). To avoid receiving unnecessary traffic alerts, the user can subscribe to receive traffic alerts only at the beginning of travel or at some interval determined by the user.

In some embodiments, the network server 130 also notifies subscribers when traffic congestion in a zone has cleared. For example, if the number of mobile devices indicating traffic congestion in a zone drops below a threshold number, the network server 130 can notify a user accordingly. The traffic clear notification may be displayed as a map, a text message or an audio message. Also, the traffic clear notification can be accompanied by a ring, vibration, or other signal or indicator of the mobile device 202A.

Figure 3:
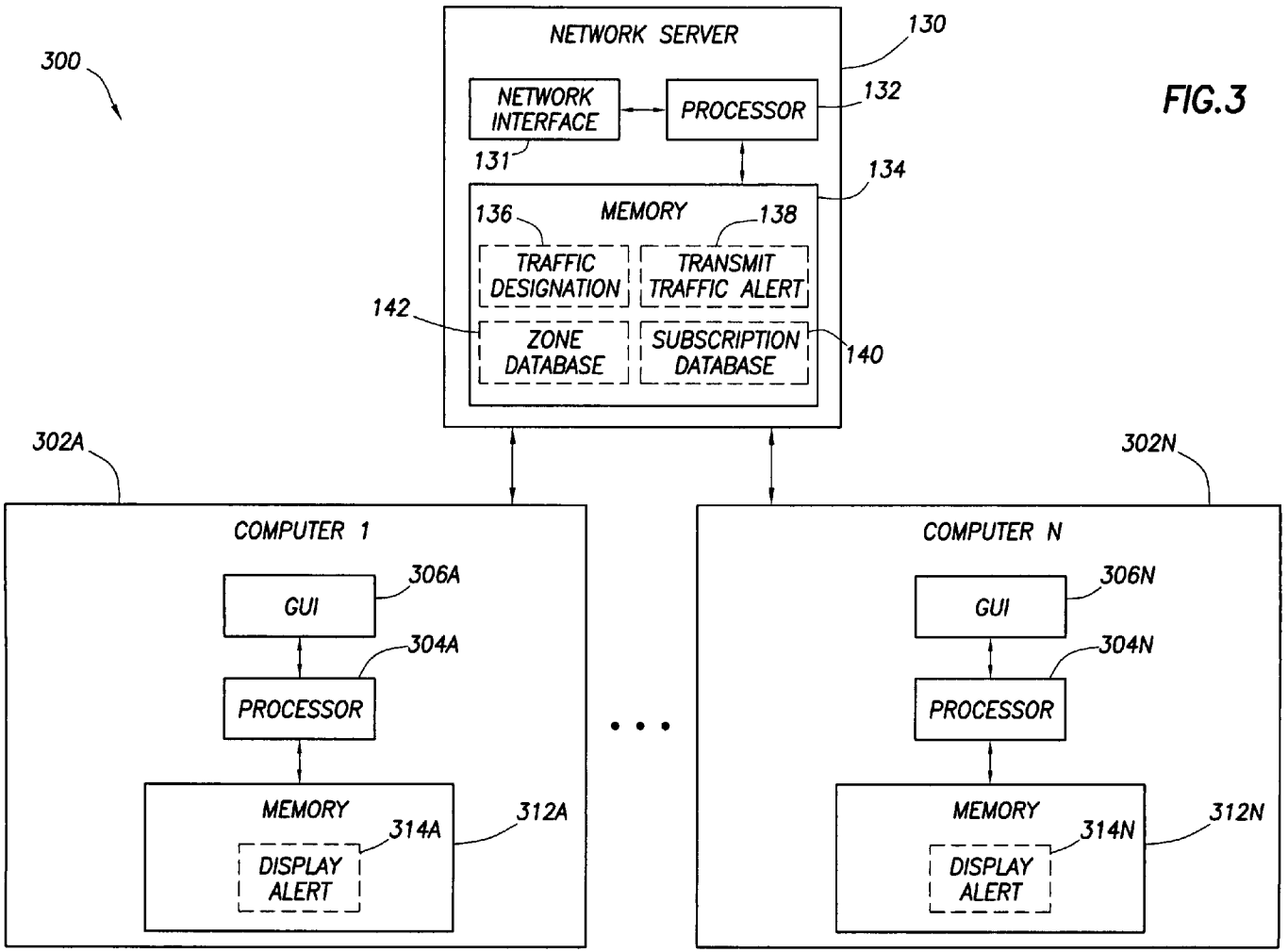
FIG. 3 illustrates another system that distributes traffic data in accordance with embodiments of the disclosure.

FIG. 3 illustrates another system 300 for distributing traffic data in accordance with embodiments of the disclosure. As shown, the system 300 comprises the network server 130 previously described. Instead of transmitting traffic alerts to mobile devices as was described in FIG. 2, the network server 130 transmits traffic alerts to a plurality of computers 302A-302N. The traffic alerts can be transmitted to the computers 302A-302N using a unique IP address associated with each computer. Only the computer 320A will be described in further detail. However, the same or similar discussion applies to the computer 302B-302N.

As shown, the computer 302A comprises a processor 304A coupled to a GUI 306A and memory 312A. The memory 312A stores display alert instructions 314A that enable the computer 302A to present a visual and/or audio alert to a user (using a GUI and speakers) based on traffic alerts transmitted from the network server 130 as previously described. In some embodiments, both mobile devices (as in FIG. 2) and computers (as in FIG. 3) are able to receive traffic updates (e.g., traffic alerts and traffic clear notifications) from the network server 130.

Figure 4:
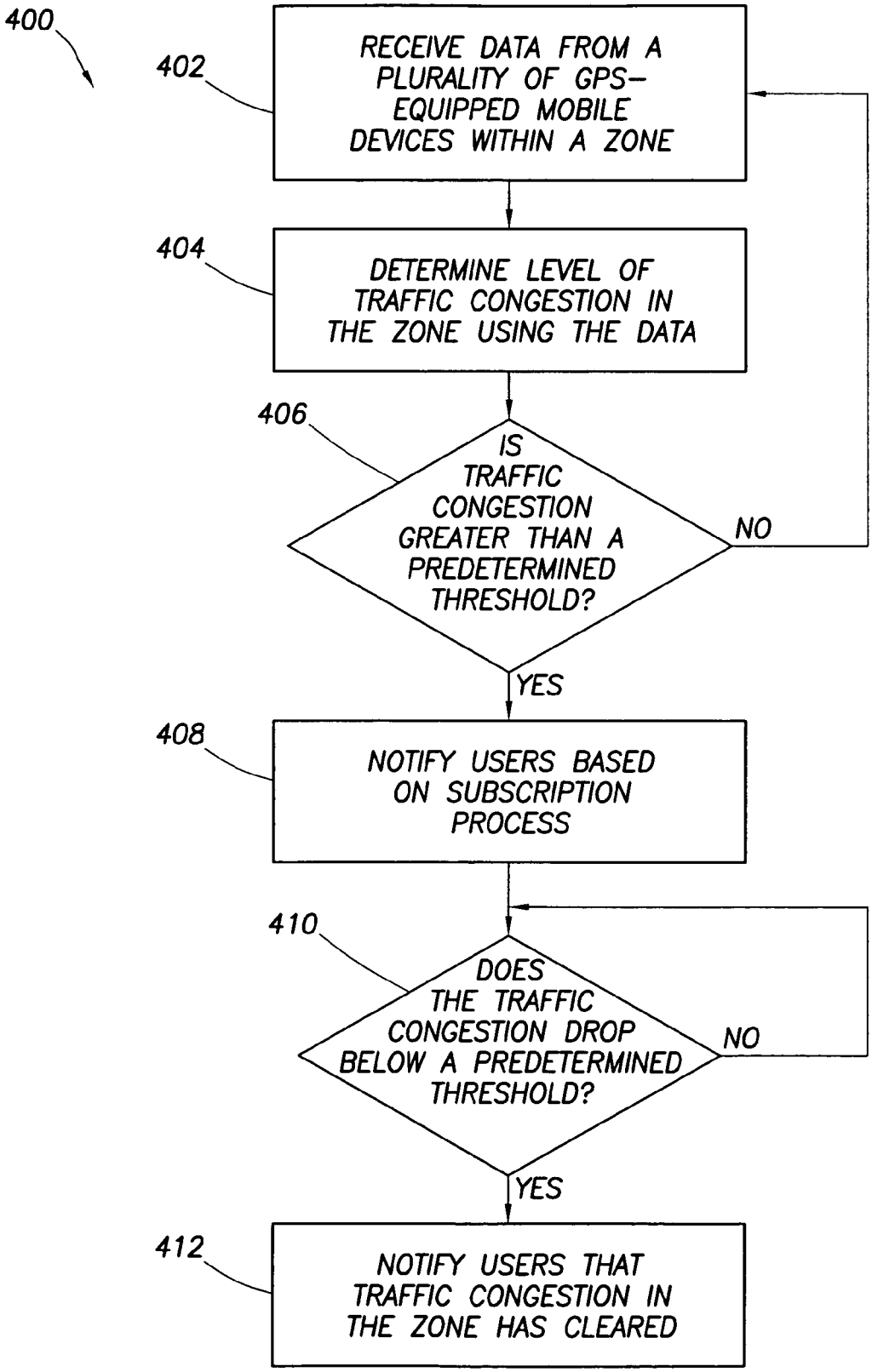
FIG. 4 illustrates a method in accordance with embodiments of the disclosure.

FIG. 4 illustrates a method 400 in accordance with embodiments of the disclosure. As shown in FIG. 4, the method 400 comprises receiving data from a plurality of GPS-equipped mobile devices in a zone (block 402). At block 404, the method 400 determines a level of traffic congestion in the zone using the data. If the traffic congestion is less than a predetermined threshold (determination block 406), the method 400 continues to receive data from a plurality of GPS-equipped mobile devices within the zone (block 402). If the traffic congestion is greater than the predetermined threshold (determination block 406), users are notified based on a subscription process (block 408). If the traffic congestion drops below the predetermined threshold (block 410), users are notified that traffic in the zone has cleared (block 412). The determination that the traffic congestion has dropped below certain thresholds may be accomplished, for example, by the server continuing to receive and process data from the GPS-equipped mobile devices within the zone after traffic congestion has been identified.

In some embodiments, the gathering and distributing of traffic data as described herein is provided by a manufacturer or distributor of cellular phones. The subscription for traffic alerts can be provided for free as an incentive to choose mobile phones provided by the manufacturer or distributor. Alternatively, the subscription process for traffic alerts can be added to a calling plan for a charge or can be part of a calling plan that includes additional services. Of course, the subscription process for traffic alerts does not have to be limited to any particular manufacturer or distributor. Additionally, the subscription process for traffic alerts can be applied to other devices besides cellular phones (e.g., navigation units, PDAs, laptop computers or desktop computers). The traffic alerts can be received by these different devices using an addressing method and communication protocol compatible with the different devices.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein, but may be modified within the scope of the appended claims along with their full scope of equivalents. For example, the various elements or components may be combined or integrated in another system or certain features may be omitted, or not implemented.

Also, techniques, systems, subsystems and methods described and illustrated in the various embodiments as discrete or separate may be combined or integrated with other systems, modules, techniques, or methods without departing from the scope of the present disclosure. Other items shown or discussed as directly coupled or communicating with each other may be coupled through some interface or device, such that the items may no longer be considered directly coupled to each other but may still be indirectly coupled and in communication, whether electrically, mechanically, or otherwise with one another. Other examples of changes, substitutions, and alterations are ascertainable by one skilled in the art and could be made without departing from the spirit and scope disclosed herein.

What is claimed is:

1. A system, comprising:

a network server configured to communicate with a plurality of mobile devices, each mobile device being associated with a vehicle, the network server configured to receive Global Positioning System (GPS) parameters from the mobile devices and traffic alert requests from a plurality of subscriber devices, wherein the traffic alert request for each of the subscriber devices comprises a selection of at least one zone and a selection of at least one time period, wherein the network server is further configured to use the GPS parameters to detect traffic congestion in a zone independently of the traffic alert requests and to determine an amount of time the zone has been designated as congested, wherein calculations performed by the network server on the GPS parameters received from each of the plurality of mobile devices to detect traffic congestion vary according to processing capabilities of the each mobile device that transmitted the GPS parameters, and wherein the network server is further configured to, after detecting traffic congestion in the zone, identify based on the traffic alert requests a first subscriber device that has requested traffic alerts for the zone at a current time and transmit a traffic alert to the first subscriber device, wherein a rate at which the network server receives the GPS parameters from at least one of the mobile devices and a rate at which the at least one mobile device detects traffic conditions vary according to a power level of the at least one mobile device and a location of the at least one mobile device with respect to a zone.

2. The system of claim 1, wherein the network server is configured to detect the traffic congestion using GPS coordinates and GPS velocity among the received GPS parameters, and to ignore other GPS parameters among the received GPS parameters in the detection of the traffic congestion.

3. The system of claim 1, wherein the network server comprises a zone database that stores a number of mobile devices that indicate traffic congestion in the zone.

4. The system of claim 1, wherein the network server is further configured to transmit the traffic alert to the first subscriber device after each passing of a predetermined interval of time.

5. The system of claim 1, wherein the network server receives GPS parameters from each mobile device only if the each mobile device determines that traffic congestion exists in the zone.

6. The system of claim 1, wherein the network server is further configured to designate the zone as congested if more than a threshold number of mobile devices in the zone provide GPS parameters that indicate traffic congestion, and designate the zone as non-congested if less than a threshold number of mobile devices in the zone provide GPS parameters that indicate traffic congestion.

7. The system of claim 6, wherein if the zone is designated as congested and is later designated as non-congested, the network server is further configured to transmit a traffic clear alert to the first subscriber device.

8. The system of claim 1, wherein when the network server detects traffic congestion in the zone, the network server is further configured to transmit no traffic alert to a second subscriber device when a determination is made that the second subscriber device has requested traffic alerts for the zone at a non-current time and to transmit no traffic alert to a third subscriber device when a determination is made that the third subscriber device has failed to request traffic alerts for the zone.

9. A mobile device, comprising:

a processor;

a Global Position System (GPS) unit coupled to the processor, wherein the GPS unit is configured to determine GPS parameters;

a memory coupled to the processor, wherein the memory is configured to store instructions that cause the processor to request the GPS parameters from the GPS unit, wherein the GPS parameters are used to detect traffic congestion in a zone and to determine an amount of time the zone has been designated as congested; and a wireless transceiver coupled to the processor, wherein the transceiver is configured to transmit a traffic alert request comprising a selection of at least one zone and a selection of at least one time period and, during the at least one selected time period, to receive from a network server a traffic alert generated based on GPS parameters determined by other mobile devices with regard to the at least one selected zone, wherein the GPS parameters are configured to be used by the network server to detect traffic congestion in the at least one selected zone independently of the traffic alert request and, after detecting traffic congestion in the at least one selected zone, to identify based on the traffic alert request the mobile device and to transmit the traffic alert to the mobile device, wherein calculations performed by the network server on the GPS parameters determined by the other mobile devices to detect traffic congestion vary according to processing capabilities of the other mobile devices that determined the GPS parameters, wherein a rate at which the mobile device transmits the GPS parameters to the network server and a rate at which the mobile device detects traffic conditions vary according to a power level of the mobile device and a location of the mobile device with respect to a zone.

10. The mobile device of claim 9, wherein the mobile device is selected from one of a mobile handset, a wireless mobile device, a mobile digital phone, a mobile cellular phone, a personal digital assistant, a portable computer, a laptop computer, a tablet computer, a vehicle based computer system, and a personal communications systems.

11. The mobile device of claim 9, wherein the memory is further configured to store zone coordinates and zone policies.

12. The mobile device of claim 11, wherein traffic congestion in the zone is detected by comparing GPS coordinates with the zone coordinates to identify a particular zone and by comparing a GPS velocity with a threshold velocity for the particular zone as indicated by the zone policies.

13. The mobile device of claim 9, further comprising a graphic user interface (GUI) coupled to the processor, wherein the traffic alert is displayed on the GUI.

14. A method, comprising:

receiving Global Positioning System (GPS) parameters from a plurality of mobile devices;

receiving traffic alert requests from a plurality of subscriber devices, wherein the traffic alert request for each of the subscriber devices comprises a selection of at least one zone and a selection of at least one time period;

detecting, independently of the traffic alert requests, traffic congestion in a zone based on the GPS parameters, wherein calculations performed on the GPS parameters received from each of the plurality of mobile devices to detect traffic congestion vary according to processing capabilities of the each mobile device that transmitted the GPS parameters;

determining an amount of time the zone has been designated as congested; and after detecting traffic congestion in the zone, identifying based on the traffic alert requests a first subscriber device that has requested traffic alerts for the zone at a current time and transmitting a traffic alert to the first subscriber device, wherein a rate at which the GPS parameters are received from at least one of the mobile devices and a rate at which the at least one mobile device detects traffic conditions vary according to a power level of the at least one mobile device and a location of the at least one mobile device with respect to a zone.

15. The method of claim 14, further comprising:

when traffic congestion is detected in the zone, transmitting no traffic alert to a second subscriber device when a determination is made that the second subscriber device has requested traffic alerts for the zone at a non-current time.

16. The method of claim 15, further comprising:

when traffic congestion is detected in the zone, transmitting no traffic alert to a third subscriber device when a determination is made that the third subscriber device has failed to request traffic alerts for the zone.

17. The method of claim 14, further comprising:

determining if traffic congestion in the zone has cleared based on the GPS parameters.

18. The method of claim 17, further comprising:

if traffic congestion in the zone is determined to have cleared, transmitting a traffic clear alert to the first subscriber device.

19. The method of claim 14, further comprising:

storing in a zone database a number of mobile devices that indicate traffic congestion in the zone.

20. The method of claim 14, further comprising:

transmitting the traffic alert to the first subscriber device after each passing of a predetermined interval of time.

* * * * *